US005659870A

United States Patent [19]

Takahara et al.

[11] Patent Number: 5,659,870

[45] Date of Patent: Aug. 19, 1997

[54] MAGNETIC TONER CONVEYING APPARATUS AND ELECTROPHOTOGRAPHIC IMAGE FORMING APPARATUS USING SAME

[75] Inventors: Hiroyuki Takahara, Kawasaki; Hironobu Saito, Yokohama, both of Japan

[73] Assignee: Canon Kabushiki Kaisha, Tokyo, Japan

[21] Appl. No.: 378,356

[22] Filed: Jan. 25, 1995

[30] Foreign Application Priority Data

Jan. 27, 1994 [JP] Japan ..... 6-023589
Jan. 20, 1995 [JP] Japan ..... 7-007423

[51] Int. Cl.[6] ..... G03G 21/10

[52] U.S. Cl. ..... 399/359; 399/358

[58] Field of Search ..... 355/298, 296; 118/652; 399/358, 359

[56] References Cited

U.S. PATENT DOCUMENTS 5,030,988 7/1991 Haneda et al. ..... 355/298 X
5,499,090 3/1996 Ito et al. ..... 355/298

FOREIGN PATENT DOCUMENTS 54-30832 3/1979 Japan ..... 355/298
56-27186 3/1981 Japan ..... 355/298
61-77882 4/1986 Japan ..... 355/298
211913 3/1990 Japan .
452774 12/1992 Japan .
6-186849 7/1994 Japan ..... 355/298
6-208320 7/1994 Japan ..... 355/298

*Primary Examiner*—Matthew S. Smith
*Attorney, Agent, or Firm*—Fitzpatrick, Cella, Harper & Scinto

[57] ABSTRACT

A magnetic toner conveying apparatus for conveying magnetic toner, which may be used with an electrophotographic image forming apparatus, comprises a non-magnetic convey path member constituting a convey path for conveying the magnetic toner, a non-magnetic convey member arranged in the convey path member and adapted to convey the magnetic toner, and a magnetic force generating member provided on or in the convey path member.

81 Claims, 6 Drawing Sheets

MAGNETIC TONER CONVEYING APPARATUS AND ELECTROPHOTOGRAPHIC IMAGE FORMING APPARATUS USING SAME

BACKGROUND OF THE INVENTION

1. Field of the Invention

The present invention relates to a magnetic toner conveying apparatus used with an electrophotographic image forming apparatus, and an electrophotographic image forming apparatus using game.

An "electrophotographic image forming apparatus" is an apparatus for forming an image on a recording medium using an electrophotographic process, such as an electrophotographic laser beam copying machine, an electrophotographic facsimile system, an electrophotographic printer, an electrophotographic word processor and the like. Incidentally, an "electrophotographic process" means that an electrostatic latent image is formed on an electrophotographic photosensitive member using a photoelectric phenomenon and the electrostatic latent image is visualized by electrostatically adhering toner to the latent image.

2. Related Background Art

In known electrophotographic image forming apparatuses, magnetic toner has been widely used for image formation. In such image forming apparatuses, an electrostatic latent image formed on a photosensitive member is developed with magnetic toner as a toner image (visualized image), and the toner image is transferred onto a recording medium such as a paper sheet. Thereafter, the toner image on the recording medium is permanently fixed to the recording medium by heat and pressure. However, all of the toner used for forming the toner image is not necessarily transferred to the recording medium; a little amount of toner remains on the photosensitive member. Thus, in order to always to obtain a high quality image, whenever a transferring operation is finished, it is necessary to remove residual toner remaining on the photosensitive member. In the past, it has been proposed that the waste or re-used toner is returned to a developing means through a convey means for re-use of the waste toner. For example, the residual toner remaining on the photosensitive member is removed by a cleaning device, and the re-used toner removed from the photosensitive member is returned to the developing means by a convey screw arranged in a return pipe and adapted to convey the toner discharged from the cleaning device to the developing means.

A toner conveying ability of a convey screw will be explained with reference to FIG. 6. The convey screw for conveying the toner is formed by (i) arranging a rigid shaft at a central portion of a spirally formed screw or (ii) forming an elongated plate in a spiral shape. As shown in FIG. 6, when the toner is conveyed in a horizontal direction by the screw of the above (i) type, as shown, as the convey screw is rotated in a clockwise direction (viewed from the right in FIG. 6), the toner T adhered to the screw blades is conveyed to the left due to the drag of the blades. In this case, the following forces act on the toner T.

When a mass of the toner is M, a coefficient of friction between the toner and the screw blade is $\mu$, an angle between the screw blade and a vertical direction is $\theta$ and the gravitational acceleration is g, the toner is subjected to a friction force of $\mu Mg\sin\theta$ generated by friction between the toner and the screw due to drag of the screw, and a component ($Mg\cos\theta$) of the gravity force Mg along a direction of the screw blade.

In this case, if the following relation (1) is satisfied, the toner is dropped along the screw blades to be stored at a lower portion of the convey path so that the toner can be conveyed by the drag of the screw in the conveying direction.

$$Mg\cos\theta > \mu Mg\sin\theta \quad (1)$$

On the other hand, if the following relation (2) is satisfied, the toner is rotated together with the screw blades while being adhered to the blades, thereby applying no conveying force to the toner, with the result that the toner is trapped at a certain position, thereby causing blocking due to poor conveyance.

$$Mg\cos\theta < \mu Mg\sin\theta \quad (2)$$

In order to avoid this, it has been proposed to reduce the coefficient of friction between the toner and the screw surface by coating the surface of the screw with Teflon. Further, the conveying force obtained by the convey screw of the above (ii) type is substantially the same as that of the convey screw of the (i) type.

By the way, since the screw of the (i) type has the shaft, there is a danger of decreasing the conveying force due to adhesion and solidification of toner around the shaft, and, since the shaft is rigid, the shaft of this kind is hard to be arranged in a curved convey path.

In the screw of the above (ii) type, since there is a space in a central portion of the screw, the toner rotated together with the screw blades can enter into the space and be dropped downwardly during the rotation of the screw, thereby permitting the conveyance of the toner. However, since a screw of this kind cannot maintain its original configuration due to its flexibility, it cannot be used with a convey path which is opened along a circumferential direction by half or more. On the other hand, in order to solve this problem, when the toner is magnetic, it has been proposed that the screw is made of magnetic material and a magnet is arranged at a lower portion of a convey path enclosing the screw, whereby the toner is forcibly gathered at a lower portion of the convey path so that the screw of the (ii) type can be used with a convey path which is opened at its upper half (see Japanese Utility Model Publication No. 4-52774).

SUMMARY OF THE INVENTION

An object of the present invention is to provide a magnetic toner conveying apparatus and an electrophotographic image forming apparatus which can convey magnetic toner stably.

Another object of the present invention is to provide a magnetic toner conveying apparatus and an electrophotographic image forming apparatus which can convey magnetic toner even along an upwardly inclined surface.

A further object of the present invention is to provide a magnetic toner conveying apparatus and an electrophotographic image forming apparatus which can convey magnetic toner efficiently.

Another object of the present invention is to provide a magnetic toner conveying apparatus and an electrophotographic image forming apparatus which has a convey screw made of non-magnetic material, a convey path made of non-magnetic material, and a magnetic force generating means arranged outside of the convey path so that magnetic toner is attracted toward a lower portion of the convey path to be conveyed by the convey screw stably and efficiently regardless of a toner conveying direction.

DETAILED DESCRIPTION OF THE PREFERRED EMBODIMENTS

Although a magnetic toner conveying apparatus which will be explained hereinbelow is applicable to any portion of an electrophotographic image forming apparatus, an embodiment wherein waste toner (used toner) collected in a cleaning device is conveyed to a developing means or a hopper of the developing means will be fully described hereinbelow. Incidentally, before the used toner is conveyed to the developing means or the hopper of the developing means, it may be conveyed to a separating apparatus for separating foreign matters from the toner. In such image forming apparatuses, a position of the hopper of the developing means is normally higher than a position of a toner reservoir of the cleaning device into which the toner is collected, and, thus, a convey path S (FIG. 9) through which the used toner is conveyed toward the developing device is inclined upwardly by an angle of δ (45° in this embodiment).

First of all, an electrophotographic copying machine to which the present invention is applied will be explained with reference to FIGS. 8 and 9.

Figure 8:
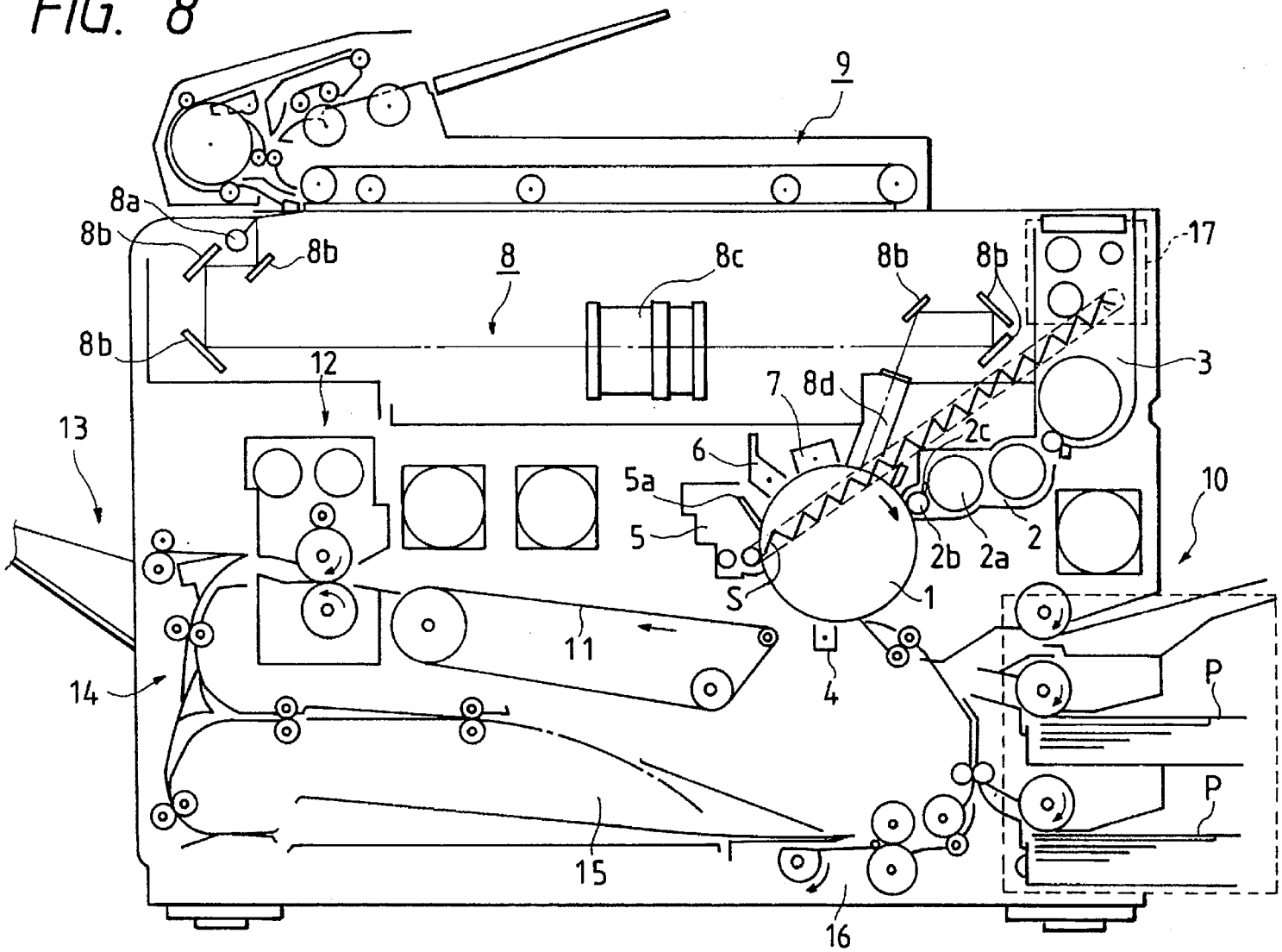
FIG. 8 is a front sectional view of an electrophotographic copying machine to which the present invention is applied.

Incidentally, in the copying machine shown in FIG. 8, magnetic toner removed from an electrophotographic photosensitive drum 1 by a cleaning device 5 is temporarily conveyed to a separating apparatus 17 through a magnetic toner conveying apparatus S. In the separating apparatus, foreign matters such as paper powder, dust and the like are separated from the magnetic toner, and magnetic toner from which the foreign matters were removed is supplied to a hopper 3. Incidentally, any conventional means can be applied in the separating apparatus 17. Further, the magnetic toner is toner including at least binding resin and magnetic carrier.

In this specification, a magnetic character means the magnetic permiability equal to or more than 2.6, and a non-magnetic character means a magnetic permeability of less than 2.6. The magnetic permiability of 2.6 is measured using the measuring method of electromagnetic guide method according to JIS (Japanese Industrial Standard) C2506–C2508.

In FIG. 8, an image forming apparatus is disclosed, i.e., a copying machine comprising an image bearing member (for example, a drum-like or belt-like electrophotographic photosensitive member) 1, a developing device 2 adapted to visualize a latent image formed on the image bearing member 1 (i.e., develop the latent image) with developer and having a hopper portion 3 for supplying the developer (one-component magnetic toner in the illustrated embodiment), a corona discharge device as transfer means 4 for transferring a toner image visualized on the image bearing member 1 onto a sheet (recording medium), a cleaning device 5 for removing residual toner and other foreign matters remaining on the image bearing member 1, an electricity removal means 6 for removing residual charge remaining on the image bearing member 1, a first charger 7 for uniformly charging the image bearing member 1, an optical reading system 8 for reading image information on an original, and an exposure portion 8*a* for exposing the image information on the image bearing member 1 to form the latent image. An original treating device 9 for directing the original to an image reading portion and a sheet supply portion 10 for supplying a sheet P to an image forming portion are associated with the image forming apparatus.

The image forming apparatus further comprises a convey means 11 for conveying the sheet P, a fixing device 12 for fixing the image (toner image) transferred to the sheet P at the image forming portion a sheet discharge portion 13 for discharging the sheet P on which the image was formed, a re-supply sheet treatment portion 14 for directing a sheet P to be re-supplied in a both-face recording mode or a multi-recording mode to the image forming portion, an intermediate tray 15 for temporarily storing the sheets to be re-supplied, and a sheet re-supplying portion 16 for supplying a sheet P stored on the intermediate tray 15 to the image forming portion.

Next, an operation of the image forming apparatus will be explained. When a copy start button (not shown) is depressed, an original in the original treating device 9 is directed to the original reading portion, to radiate an image surface by a light source 8*a*, and to form the reflected light via a mirror 8*b* and an image-forming lens 8*c* as the light image. On the other hand, image information on the original may be read by the optical reading system 8.

On the other hand, the image bearing member 1 from which electric charge was previously removed by the electricity removal means 6 is charged to a predetermined potential by the first charger 7, and then, at the exposure portion 8*d*, the image information is written on the image bearing member as a latent image. The latent image formed on the image bearing member 1 is visualized with magnetic toner by the developing device 2 as a toner image. When the amount of magnetic toner in the developing device 2 decreases, new magnetic toner is replenished to the developing device from the hopper portion 3. That is, the magnetic toner supplied from the hopper portion 3 is fed by the toner feed roller 2*a* to be adhered to a surface of a developing roller 2*b*. Thus, a thickness of the layer is regulated by a developing blade 2*c*. A developing bias is applied between the developing roller 2*b* and the photosensitive drum 2 to develope the latent image formed on the drum. When a sheet P is sent to a transfer station of the image forming portion from the sheet supply portion 10, the toner image formed on the image bearing member 1 is transferred onto the sheet P by the transfer means 4. After the transferring operation, the sheet P is sent to the fixing device 12, where the toner image is fixed to the sheet P.

After the fixing operation, in a one-face copy mode, the sheet P is discharged to the discharge portion 13. On the other hand, in a both-face copy mode or a multi-copy mode, the sheet P is not discharged to the discharge portion, but is sent to the re-supply sheet treatment portion 14, by which the sheet P is stored on the intermediate tray 15. When a predetermined number of sheets are stacked on the intermediate tray, the sheets are separated one by one by means of the re-supplying portion 16, and a separated sheet P is re-supplied to the transfer station of the image forming portion. When a next original is sent to the image reading portion by the original treating device 9, the above mentioned image forming operations are repeated, thereby forming a toner image on the other surface of the sheet. Then, the sheet is discharged to the discharge portion 13.

After the transferring operation, unused toner (which was not transferred from the image bearing member 1 to the sheet P) and paper powder, dust and the like (referred to as "foreign matters" hereinafter) remaining on the image bearing member are removed by the cleaning device 5 (In the illustrated embodiment, the toner and the foreign matters remaining on the image bearing member 1 are removed by an elastic cleaning blade 5*a*). The removed toner and foreign matter are fed to a separation device 17 by a magnetic toner convey device S.

Figure 1:
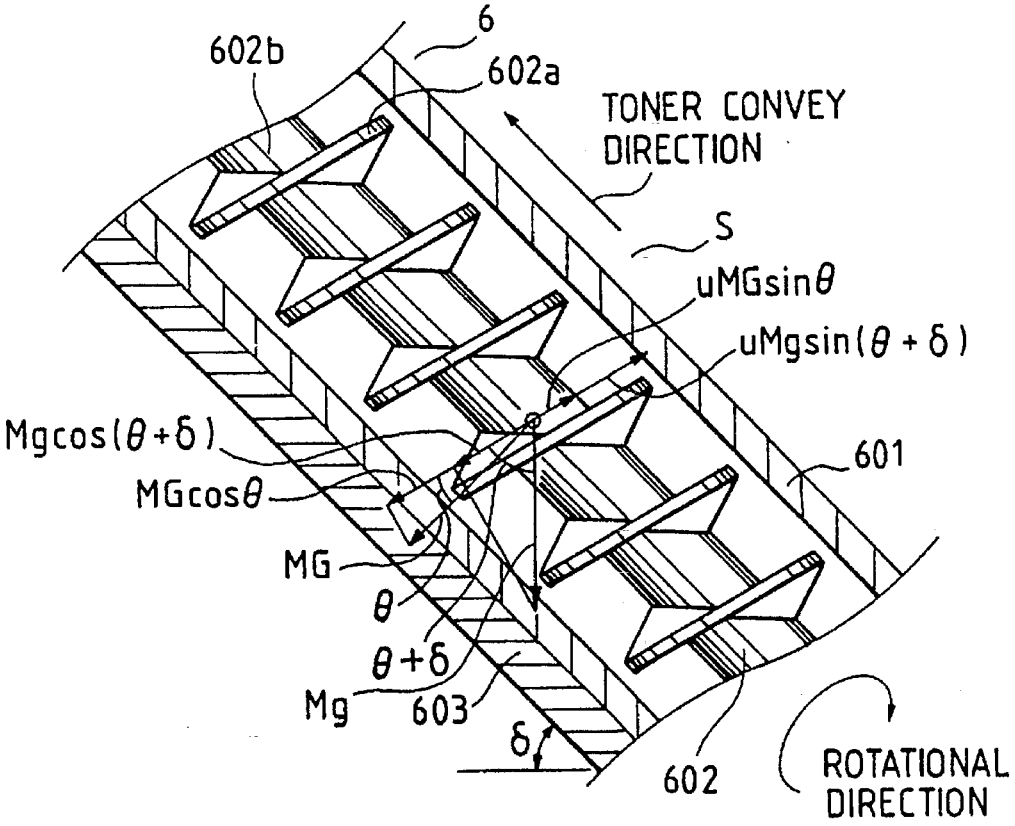
FIG. 1 is a side sectional view of a main portion of a conveying apparatus according to a preferred embodiment of the present invention.

FIG. 1 is a sectional view of a magnetic toner conveying apparatus S for conveying the used toner removed from the photosensitive drum 1, taken along a longitudinal axis of the apparatus. It is assumed that the used toner collected in the cleaning device 5 (see FIG. 8) is conveyed from a right lower side to a left upper side (FIG. 1). The conveying apparatus S comprises a convey pipe 601 made of non-magnetic material such as mold material, aluminium or the like, a convey screw 602 having screw blades 602*a* made of non-magnetic material such as mold material, aluminium or the like and a shaft 602*b* made of non-magnetic material such as mold material, stainless steel or the like and supporting the screw blades, and a magnetic force generating member 603 such as a rubber magnet, plastic magnet and the like mounted on an undersurface of the convey pipe 601.

Figure 9:
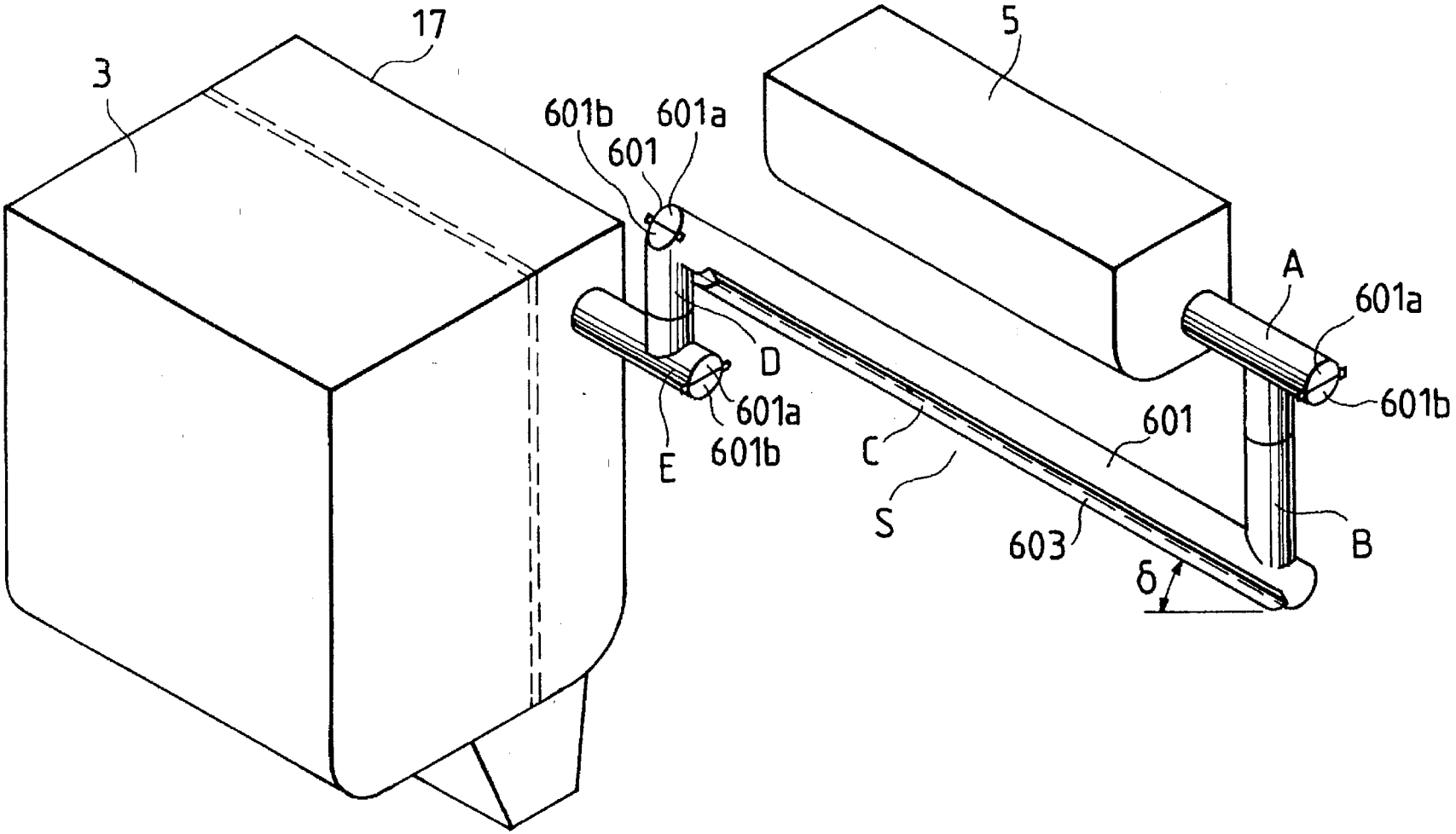
FIG. 9 is a partial perspective view of the electrophotographic copying machine of FIG. 8.

Incidentally, as shown in FIG. 9, the conveying apparatus S has a portion A protruded from the cleaning device 5 toward a longitudinal direction of the cleaning device 5, a portion B branched from the portion A in a vertical direction, a portion C connected to the portion B and inclined upwardly toward the separating apparatus 17, a portion D branched from the portion C in a vertical direction, a portion E connecting the portion D to the separating apparatus 17, and a magnetic force generating member 603 such as a rubber magnet, plastic magnet and the like mounted on an undersurface of the convey pipe 601.

When the toner is conveyed, if an inclination angle $\delta$ of the convey pipe is great to satisfy the above relation (2), a toner conveying force is generally decreased. However, in the convey pipe having the magnet 603 as shown in FIG. 1, when a magnetic force of the magnet is MG, the toner is subjected to a component of the magnetic force in a tangential direction of the screw blade 602 (=MG cos$\theta$) and a friction force of the screw blade 602*a* in a drag direction (=$\mu$MG sin$\theta$). Accordingly, when the magnetic force of the magnet 603 is set to satisfy the following relation (3), the magnetic toner in the pipe 601 can be attracted by the magnetic force of the magnet 603 to be slidingly dropped along the surfaces of the screw blades 602*a* so that the toner is gathered at lower portions of the screw blades 602*a*, thereby permitting the conveyance of the toner by the screw 602.

$$Mg\cos(\theta+\delta)+MG\cos\theta>\mu Mg\sin(\theta+\delta)+\mu MG\sin(\theta+\delta) \quad (3)$$

As an example, when the angle $\delta$ is about 45°, the material of the convey pipe 601 is polycarbonate, a thickness of the pipe 601 is about 2 mm and the magnetic, flux density is about 1000 gauss (0.1 Tesla), the toner particles are dropped from the surfaces of the screw blades 602*a* to be gathered at the lower portion of the pipe 601, with the result that the toner can be conveyed effectively.

Since there is a small gap between an inner surface of the convey pipe 601 and an outer periphery of the screw blades 602*a*, the toner in the gap is normally hard to convey. However, in the illustrated embodiment, since the toner is attracted by the magnetic force of the magnet 603 to be gathered at the lower portion of the pipe 601, the toner in the gap can efficiently be conveyed in the conveying direction by the drag force of the screw 602 in the conveying direction.

Further, regarding a circumferential angle range within which the magnet is mounted, if the angle range is small, then the amount of toner caught by the magnet will decrease, thereby reducing the amount of toner conveyed. On the other hand, if the angle range is too great (for example, 360°), then in order to attract the toner upwardly in opposition to the gravity force, the magnetic force of the upper area of the magnet must be increased to provide an effective conveying ability, thereby making the apparatus expensive.

Figure 2:
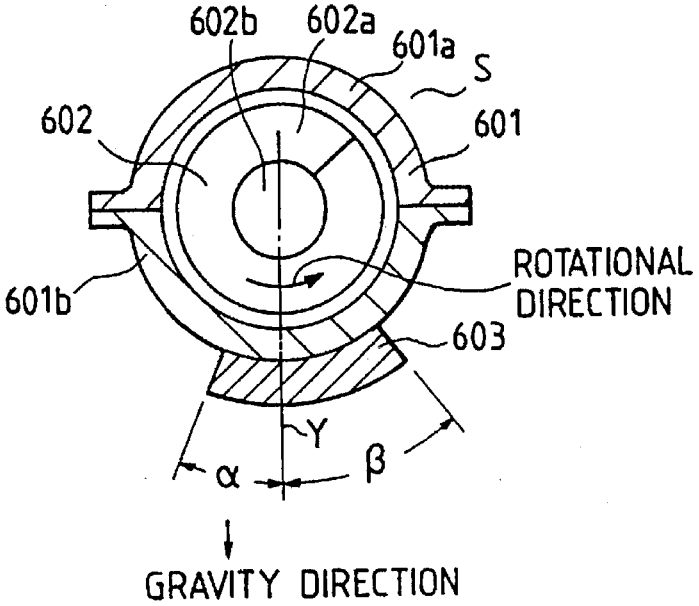
FIG. 2 is a cross-sectional view of the conveying apparatus of FIG. 1.

FIG. 2 is a cross-sectional view of the convey pipe 601. As shown, if the angle range $\beta$ of the magnet 603 in the rotational direction of the convey screw 602 is greater than 90°($\beta$>90°), then it is not preferable because a portion of the toner is rotated together with the screw 602. Further, within the angle range $\beta$, since the gravity direction is opposite to the rotational direction, it is preferable that the angle range is wider and the magnetic force of the magnet is stronger. Regarding an angle range $\alpha$ extending in a direction opposite to the rotational direction of the screw, since the rotational direction of the screw is the same as the gravity direction, the magnetic force of the magnet does not need to be so great.

Thus, when a magnet 603 having a predetermined size is mounted on the pipe 601, it is preferable to set $\alpha<90°$, $\beta\leqq 90°$, and $\alpha<\beta$.

Incidentally the angle $\alpha$ is an angle measured from a vertical line Y passing through a rotational center X of the screw 602 (center 602 of the shaft 602*b*) along a direction (anti-clockwise direction) opposite to the rotational direction of the screw 602, and the angle $\beta$ is an angle measured from the vertical line Y in the rotational direction (clockwise direction) of the screw.

Incidentally, in the above-mentioned embodiment, while an example has been illustrated in which the used magnetic toner collected in the cleaning device is conveyed to the developing means, the present invention is not limited to such an example, but can be applied to a case where new toner is conveyed.

Further, in the above-mentioned embodiment, while an example has been illustrated in which the toner is conveyed in the upwardly inclined direction, the present invention is, of course, applicable to a case where the toner is conveyed in a horizontal direction. That is to say, although it is conventionally considered that a surface of a screw is coated by Teflon to reduce the coefficient of friction of the surface so that the sliding movement of the toner on the screw surface is enhanced, according to the present invention, since the magnet is mounted on the undersurface of the convey path to forcibly attract the magnetic toner to the lower portion of the convey path, a sufficient conveying force can be obtained.

Figure 3:
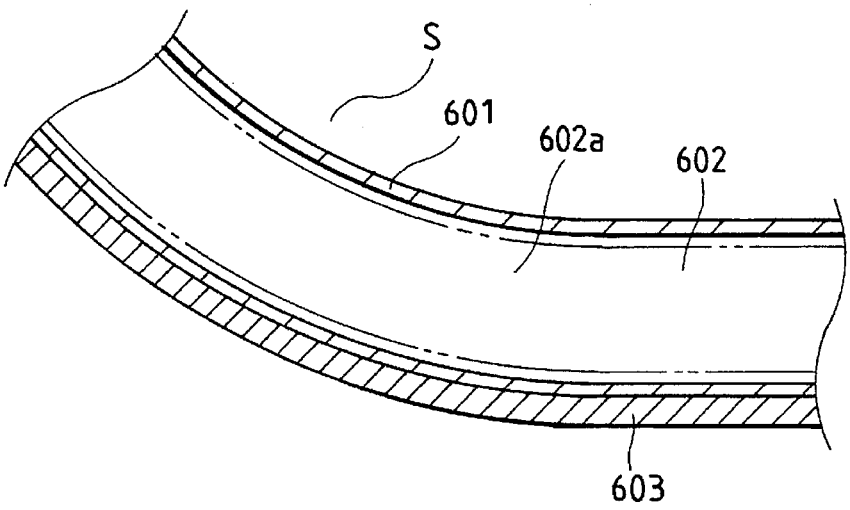
FIG. 3 is a side sectional view of a main portion of a conveying apparatus according to another embodiment of the present invention.

Next, another embodiment of the present invention will be explained. FIG. 3 is a partial sectional view of a conveying apparatus according to another embodiment of the present invention. As is in the conveying apparatus according to the above-mentioned embodiment, a convey screw 602 is rotatably mounted within a convey pipe 601. A magnet 603 is mounted on an undersurface of the convey pipe 601. In this embodiment, as shown in FIG. 3, since the convey pipe is curved, a convey screw 602 having no shaft is used.

Figure 4:
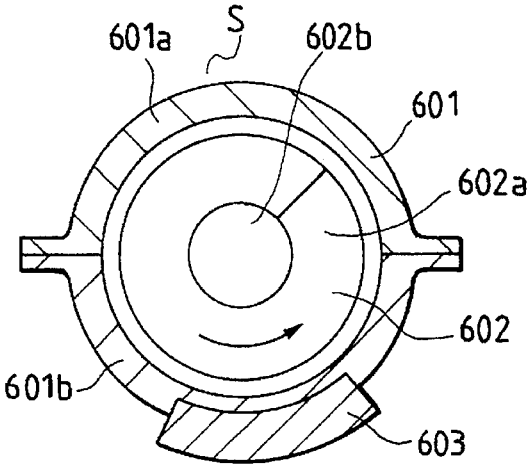
FIG. 4 is a cross-sectional view of the conveying apparatus of FIG. 2.

When such a curved pipe is formed, particularly when a pipe-shaped convey path is formed by plastic material, upper and lower half pipe members 601*a*, 601*b* each having a semi-circular cross-section are prepared, and these half pipe members are secured to each other by an adhesive or heat-caulking to form the pipe 601 (see FIGS. 2 and 4). When the magnet 603 is mounted on such a pipe 601, it is preferable that a magnet curved to conform to the curvature of the curved pipe is attached to the pipe. With this arrangement, the magnet 603 can be mounted to the pipe to conform to the curvature of the pipe and to correctly align with the pipe in the circumferential direction.

In the embodiment shown in FIG. 4, when the lower half pipe member 601*b* is formed, the magnet 603 is previously molded integrally with the lower half pipe member at a predetermined position, and the assembly is secured to the upper half pipe portion 601*a* to form the pipe 601. With this arrangement, it is possible to correctly position the magnet with respect to the convey screw without any specific technique.

Figure 5:
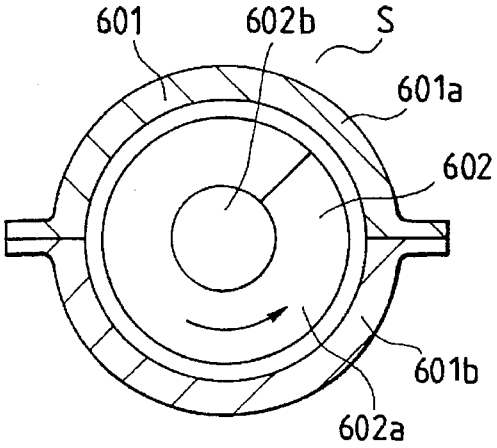
FIG. 5 is a cross-sectional view of a conveying apparatus according to a further embodiment of the present invention.
Figure 6:
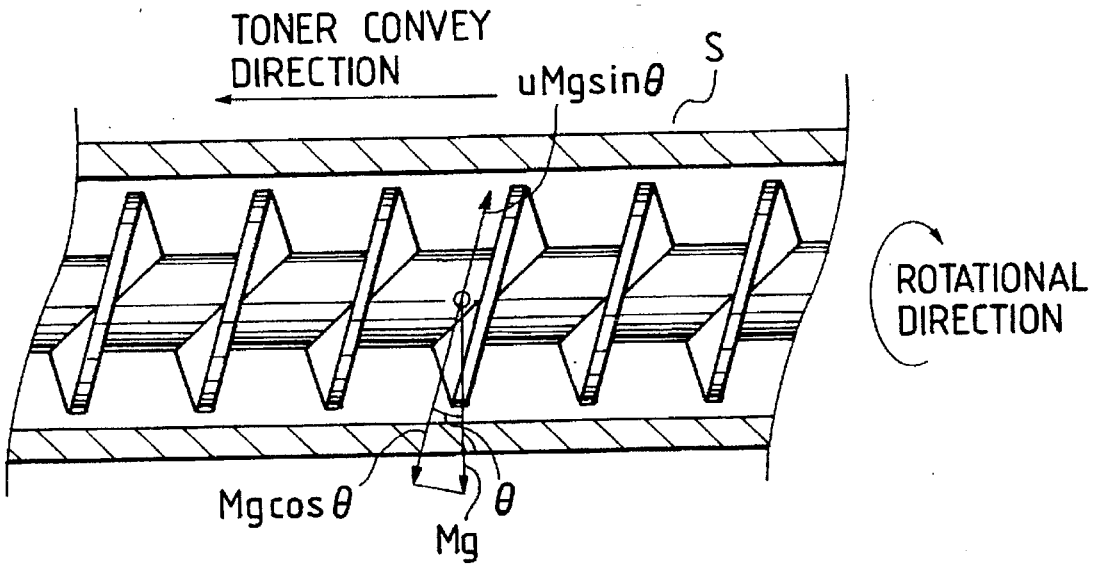
FIG. 6 is a side sectional view of a main portion of the conveying apparatus showing a condition in which toner is conveyed in a horizontal direction.
Figure 7:
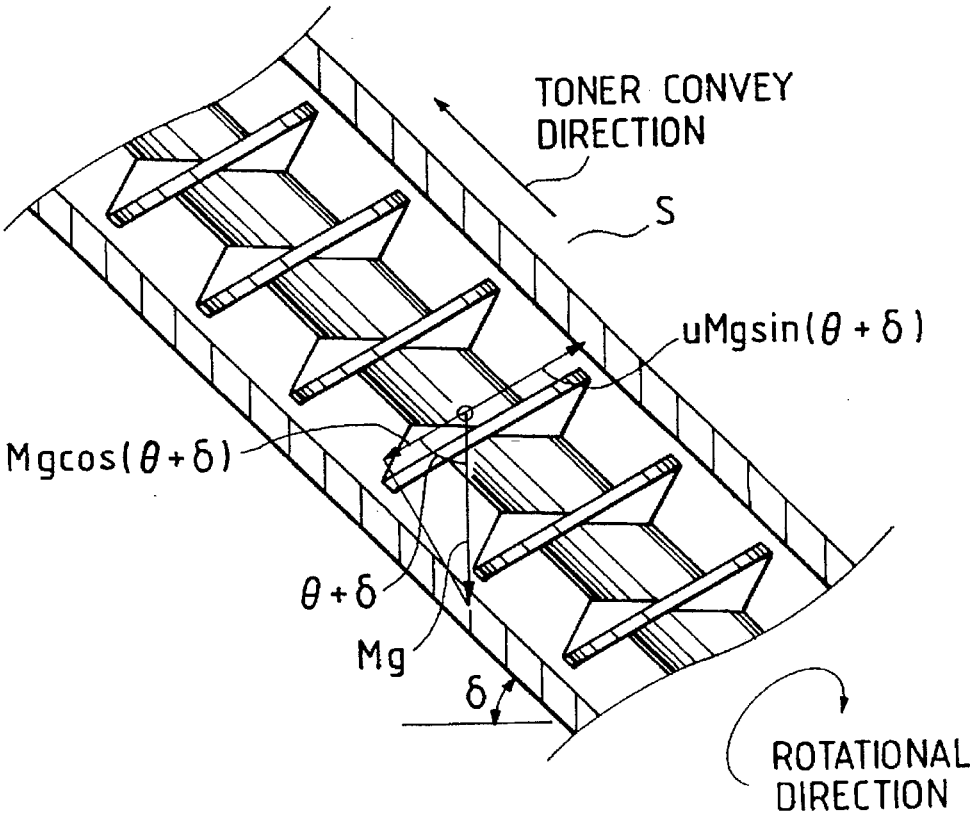
FIG. 7 is a side sectional view of a main portion of the conveying apparatus showing a condition in which toner is conveyed in an upwardly inclined direction.

Next, a further embodiment of the present invention will be explained. FIG. 5 is a partial sectional view of a conveying apparatus according to another embodiment of the present invention. As is in the conveying apparatus according to the above-mentioned embodiment, regarding a curved portion of a convey pipe, a plastic magnet is previously formed as a lower half pipe portion 601*b* to have a predetermined magnetic force.

In this case, since the magnetic force can be set in the convey path directly, the magnetic force can act on the magnetic toner more effectively, and, since there is no intermediate element, the magnetic force can be selected to be smaller, thereby reducing the magnetic influence upon the environment.

Figure 10:
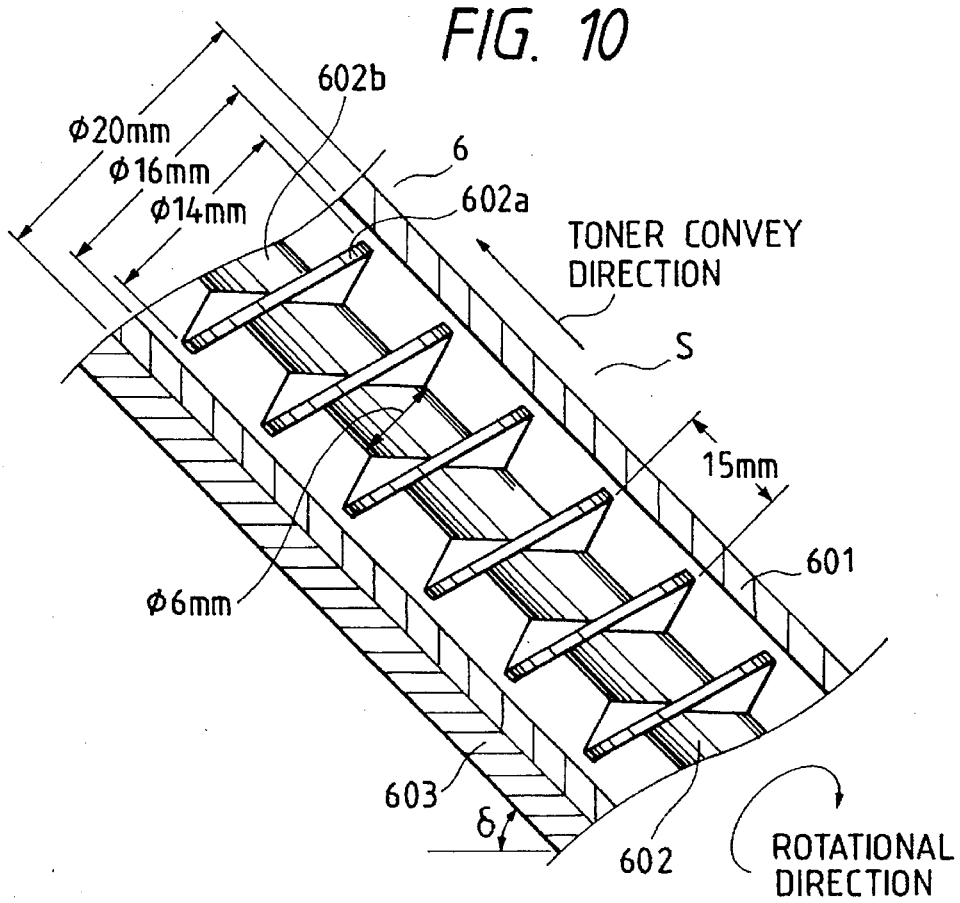
FIG. 10 is similar to FIG. 1, but with concrete numerical values.
Figure 11:
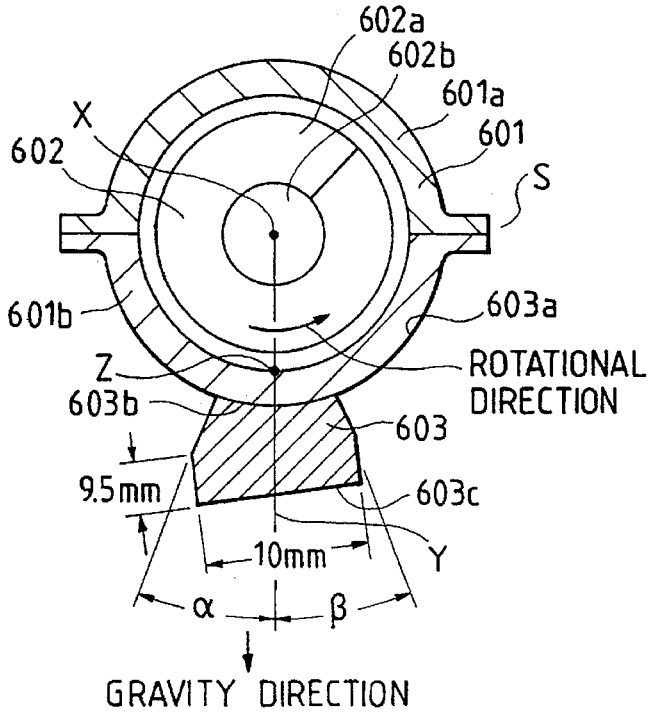
FIG. 11 is a cross-sectional view of the conveying apparatus of FIG. 10.

Now, a concrete numerical example will be described with reference to FIGS. 10 and 11. According to an embodiment shown in FIGS. 10 and 11, when the inclination angle $\delta$ was selected to be about 45°, it was found that the one-component magnetic toner (for example, magnetic oxide iron toner using polyester as binder and manufactured by Canon Inc. in Japan) can effectively be conveyed from the cleaning device 5 to the separating apparatus 17.

Further, the pipe 601 was made of plastic material such as acrylonitrile/butadien/styrene copolymer (ABS resin) or polycarbonate resin (PC resin). An inner diameter of the pipe 601 was about 16 mm, an outer diameter thereof was about 20 mm and a thickness thereof was about 2 mm.

Further, regarding the convey screw 602, the shaft 602*b* was made of stainless steel (SUS 303), and a plurality of spiral blades 602*a* made of acrylonitrile/butadien/styrene copolymer (ABS resin) were equidistantly attached to the shaft. Alternatively, the blades 602*a* and the shaft 602*b* were integrally formed of a plastic material such as polycarbonate resin (PC resin). A diameter of the shaft 602*b* was about 6 mm, an outer diameter of each blade 602*a* was about 14 mm, and an interval (pitch) between the blades 602*a* attached to the shaft 602*b* was about 15 mm. The screw 602 was rotated at 276 r.p.m. by a driving force of a motor (not shown).

Further, the magnet 603 was formed from a plastic magnet. The plastic magnet 603 was attached to the outer surface of the pipe 601*b* via a both-face adhesive tape 603*a* and a tie-wrap band. Incidentally, a mounting range through which the plastic magnet 603 is attached to the pipe extended from the vertical line Y passing through the rotational center X of the screw 602 (center X of the shaft 602*b*) by an angle $\alpha$ of about 20° in the direction opposite to the rotational direction of the screw 602 and by an angle $\beta$ of about 20° in the rotational direction of the screw. That is to say, the magnet 603 was mounted symmetrically with respect to the vertical line Y. Further, in the illustrated embodiment, in consideration of the easy workability, the plastic magnet 603 was shaped as shown in FIG. 11. That is to say, a surface portion 603*b* of the magnet by which the magnet is attached to the pipe 601*b* was arcuate to conform to the pipe surface, and a body portion 603*c* was made rectangular for easy workability (length of about 9.5 mm and width of about 10 mm). Further, the magnetic force of the plastic magnet 603 was selected to be about $630\times10^{-4}$ Tesla (about 630 gauss) measured at a position spaced apart from the surface of the magnet 603 by about 2 mm. Incidentally, the magnetic force of the magnet 603 was measured at a point Z where the vertical line Y intersects with the inner surface of the pipe 601*b*. Further, half widths of the magnet were 21° with respect to the vertical line Y on both sides thereof, respectively. However, the magnetic force of the magnet 603 was sufficient to be about 500 to 700 gauss at a point remote from the surface by about 2 mm.

According to the above-mentioned embodiments, the convey means are constituted by the non-magnetic convey path and the non-magnetic convey screw mounted within the convey path. Further, the magnet is arranged below the convey path. In this way, it is designed so that the magnetic toner to be conveyed can be smoothly dropped from the convey screw to be gathered at the lower portion of the convey path. Thus, the toner can be conveyed even in the upwardly inclined direction efficiently with a simple construction having only the magnetic force generating member arranged in place without any complex additional mechanisms. Further, by forming a part of the convey path with the magnetic force generating member, the assembling ability of the apparatus can be improved and the magnetic force can be utilized correctly and efficiently. Furthermore, by adopting the toner conveying apparatus to an image forming apparatus, since the used toner collected in the cleaning device can positively be returned to the developing means to be re-used, the freedom of design of the image forming apparatus is increased and the cost is reduced.

As mentioned above, according to the present invention, the magnetic toner can positively be conveyed.

What is claimed is:

1. A magnetic toner conveying apparatus for an electrophotographic image forming apparatus, comprising:

a non-magnetic convey path member forming a tubular convey path for conveying magnetic toner;

a non-magnetic rotary convey member arranged within said tubular convey path for conveying magnetic toner along a length of the convey path; and a magnetic force generating member provided on an outer surface of said convey path member along the length of the convey path.

2. A magnetic toner conveying apparatus according to claim 1, wherein said convey path member has a cylindrical shape enclosing said convey member.

3. A magnetic toner conveying apparatus according to claim 1 or 2, wherein said convey member comprises a shaft and at least one blade attached to said shaft so that the magnetic toner is continuously conveyed by rotating said shaft.

4. A magnetic toner conveying apparatus according to claim 3, wherein said convey path member is made of plastic, aluminum or stainless steel.

5. A magnetic toner conveying apparatus according to claim 4, wherein said convey member is made of plastic, aluminum or stainless steel.

6. A magnetic toner conveying apparatus according to claim 5, wherein the magnetic toner conveying apparatus conveys magnetic toner removed from an electrophotographic photosensitive member to be re-used for developing a latent image formed on said electrophotographic photosensitive member.

7. A magnetic toner conveying apparatus according to claim 5, wherein said convey path member connects a cleaning means for removing magnetic toner remaining on an electrophotographic photosensitive member to separating means for separating foreign matter from the magnetic toner.

8. A magnetic toner conveying apparatus according to claim 7, wherein said convey path member is upwardly inclined.

9. A magnetic toner conveying apparatus according to claim 7, wherein said magnetic force generating member is arranged outside of said convey path member.

10. A magnetic toner conveying apparatus according to claim 7, wherein said magnetic force generating member forms a part of said convey path member.

11. A magnetic toner conveying apparatus according to claim 5, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite to said rotational direction.

12. A magnetic toner conveying apparatus according to claim 4, wherein the magnetic toner conveying apparatus conveys magnetic toner removed from an electrophotographic photosensitive member to be re-used for developing a latent image formed on said electrophotographic photosensitive member.

13. A magnetic toner conveying apparatus according to claim 4, wherein said convey path member connects cleaning means for removing magnetic toner remaining on an electrophotographic photosensitive member to separating means for separating foreign matter from the magnetic toner.

14. A magnetic toner conveying apparatus according to claim 13, wherein said convey path member is upwardly inclined.

15. A magnetic toner conveying apparatus according to claim 13, wherein said magnetic force generating member is arranged outside of said convey path member.

16. A magnetic toner conveying apparatus according to claim 13, wherein said magnetic force generating member forms a part of said convey path member.

17. A magnetic toner conveying apparatus according to of claim 3, wherein said convey member is made of plastic, aluminum or stainless steel.

18. A magnetic toner conveying apparatus according to claim 17, wherein the magnetic toner conveying apparatus conveys magnetic toner removed from an electrophotographic photosensitive member to be re-used for developing a latent image formed on said electrophotographic photosensitive member.

19. A magnetic toner conveying apparatus according to claim 17, wherein said convey path member connects cleaning means for removing magnetic toner remaining on an electrophotographic photosensitive member to separating means for separating foreign matter from the magnetic toner.

20. A magnetic toner conveying apparatus according to claim 19, wherein said convey path member is upwardly inclined.

21. A magnetic toner conveying apparatus according to claim 19, wherein said magnetic force generating member is arranged outside of said convey path member.

22. A magnetic toner conveying apparatus according to claim 19, wherein said magnetic force generating member forms a part of said convey path member.

23. A magnetic toner conveying apparatus according to claim 17, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite to said rotational direction.

24. A magnetic toner conveying apparatus according to claim 1 or 2, wherein said convey path member is made of plastic, aluminum or stainless steel.

25. A magnetic toner conveying apparatus according to of claim 24, wherein said convey member is made of plastic, aluminum or stainless steel.

26. A magnetic toner conveying apparatus according to claim 25, wherein the magnetic toner conveying apparatus conveys magnetic toner removed from an electrophotographic photosensitive member to be re-used for developing a latent image formed on said electrophotographic photosensitive member.

27. A magnetic toner conveying apparatus according to claim 25, wherein said convey path member connects cleaning means for removing magnetic toner remaining on an electrophotographic photosensitive member to separating means for separating foreign matter from the magnetic toner.

28. A magnetic toner conveying apparatus according to claim 27, wherein said convey path member is upwardly inclined.

29. A magnetic toner conveying apparatus according to claim 27, wherein said magnetic force generating member is arranged outside of said convey path member.

30. A magnetic toner conveying apparatus according to claim 27, wherein said magnetic force generating member forms a part of said convey path member.

31. A magnetic toner conveying apparatus according to claim 25, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite to said rotational direction.

32. A magnetic toner conveying apparatus according to claim 24, wherein the magnetic toner conveying apparatus conveys magnetic toner removed from an electrophotographic photosensitive member to be re-used for developing a latent image formed on said electrophotographic photosensitive member.

33. A magnetic toner conveying apparatus according to claim 24, wherein said convey path member connects cleaning means for removing magnetic toner remaining on an electrophotographic photosensitive member to separating means for separating foreign matter from the magnetic toner.

34. A magnetic toner conveying apparatus according to claim 33, wherein said convey path member is upwardly inclined.

35. A magnetic toner conveying apparatus according to claim 33, wherein said magnetic force generating member is arranged outside of said convey path member.

36. A magnetic toner conveying apparatus according to claim 33, wherein said magnetic force generating member forms a part of said convey path member.

37. A magnetic toner conveying apparatus according to claim 1 or 2, wherein said convey member is made of plastic, aluminum or stainless steel.

38. A magnetic toner conveying apparatus according to claim 37, wherein the magnetic toner conveying apparatus conveys magnetic toner removed from an electrophotographic photosensitive member to be re-used for developing a latent image formed on said electrophotographic photosensitive member.

39. A magnetic toner conveying apparatus according to claim 37, wherein said convey path member connects cleaning means for removing magnetic toner remaining on an electrophotographic photosensitive member to separating means for separating foreign matter from the magnetic toner.

40. A magnetic toner conveying apparatus according to claim 39, wherein said convey path member is upwardly inclined.

41. A magnetic toner conveying apparatus according to claim 39, wherein said magnetic force generating member is arranged outside of said convey path member.

42. A magnetic toner conveying apparatus according to claim 39, wherein said magnetic force generating member forms a part of said convey path member.

43. A magnetic toner conveying apparatus according to claim 37, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite to said rotational direction.

44. A magnetic toner conveying apparatus according to claim 1, wherein said magnetic force generating member is arranged outside of said convey path member.

45. A magnetic toner conveying apparatus according to claim 1, wherein said magnetic force generating member forms a part of said convey path member.

46. A magnetic toner conveying apparatus according to claim 1, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite said rotational direction.

47. A magnetic toner conveying apparatus according to claim 1, wherein the magnetic toner conveying apparatus conveys magnetic toner removed from an electrophotographic photosensitive member to be re-used for developing a latent image formed on said electrophotographic photosensitive member.

48. A magnetic toner conveying apparatus according to claim 1, wherein said convey path member connects cleaning means for removing magnetic toner remaining on an electrophotographic photosensitive member to separating means for separating foreign matter from the magnetic toner.

49. A magnetic toner conveying apparatus according to claim 48, wherein said convey path member is upwardly inclined.

50. A magnetic toner conveying apparatus according to claim 48, wherein said magnetic force generating member is arranged outside of said convey path member.

51. A magnetic toner conveying apparatus according to claim 48, wherein said magnetic force generating member forms a part of said convey path member.

52. A magnetic toner conveying apparatus for an electrophotographic image forming apparatus, comprising:

a non-magnetic cylindrical member forming a tubular convey path through which magnetic toner removed from an electrophotographic photosensitive member by cleaning means is conveyed to separating means for separating foreign matter from the magnetic toner;

a non-magnetic screw member arranged within the tubular convey path of said cylindrical member and adapted to convey magnetic toner along a length of the convey path; and a magnet arranged outside of said cylindrical member along the length of the convey path.

53. A magnetic toner convey apparatus according to claim 52, wherein said cylindrical member is made of plastic, aluminum or stainless steel.

54. A magnetic toner conveying apparatus according to claim 53, wherein the cylindrical member is made of a plastic selected from the group consisting of acrylonitrile/butadien/styrene copolymer (ABS resin) and polycarbonate resin (PC resin).

55. A magnetic toner conveying apparatus according to claim 52 or 53, wherein said screw member is made of plastic, aluminum or stainless steel.

56. A magnetic toner conveying apparatus according to claim 55, wherein said screw member comprises a shaft made of stainless steel and a blade made of acrylonitrile/butadien/styrene copolymer (ABS resin) attached to said shaft, or a shaft and a blade which are integrally formed of polycarbonate resin (PC resin).

57. A magnetic toner conveying apparatus according to claim 55, wherein said magnet is a plastic magnet.

58. A magnetic toner conveying apparatus according to claim 57, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and $\beta$ is an angle measured in a direction opposite to said rotational direction.

59. A magnetic toner conveying apparatus according to claim 52 or 53, wherein said magnet is a plastic magnet.

60. A magnetic toner conveying apparatus according to claim 52, wherein said magnetic force generating member is arranged through an angle range which is measured from a gravity direction and is selected to be $\alpha<90°$, $\beta\leqq 90°$ and $\alpha<\beta$, where $\alpha$ is an angle measured in a rotational direction of said convey member and S is an angle measured in a direction opposite said rotational direction.

61. A magnetic toner conveying apparatus for an electrophotographic image forming apparatus, comprising:

a plastic cylindrical member forming a tubular convey path through which magnetic toner removed from an electrophotographic photosensitive member by cleaning means is conveyed to separating means for separating foreign matter from the magnetic toner;

a non-magnetic plastic screw member arranged within the tubular convey path of said cylindrical member and adapted to convey the magnetic toner along a length of the convey path; and a plastic magnet arranged outside of said cylindrical member along the length of the convey path.

62. A magnetic toner conveying apparatus according to claim 61, wherein said plastic cylindrical member is made of acrylonitrile/butadien/styrene copolymer (ABS resin) or polycarbonate resin (PC resin).

63. A magnetic toner conveying apparatus according to claim 61 or 62, wherein said plastic screw member comprises a shaft and a blade which are integrally formed of polycarbonate resin (PC resin).

64. A magnetic toner conveying apparatus according to claim 63, wherein said plastic magnet has a magnetic force of about 500–700 gauss at a point remote from the surface by about 2 mm.

65. A magnetic toner conveying apparatus according to claim 64, wherein said magnetic force generating member is arranged through an angle range which is measured from a gravity direction and is selected to be $\alpha<90°$, $\beta\leqq90°$ and $\alpha<\beta$, where $\alpha$ is an angle measured in a rotational direction of said convey member and $\beta$ is an angle measured in a direction opposite to said rotational direction.

66. A magnetic toner conveying apparatus according to claim 63, wherein said plastic magnet has a magnetic force of about 500–700 gauss at point remote from the surface by about 2 mm.

67. A magnetic toner conveying apparatus according to claim 61 or 62, wherein said plastic magnet has a magnetic force of about 500–700 gauss at point remote from the surface by about 2 mm.

68. A magnetic toner conveying apparatus according to claim 62, wherein said plastic magnet has a magnetic force of about 500–700 gauss at point remote from the surface by about 2 mm.

69. A magnetic toner conveying apparatus according to claim 61, wherein said plastic magnet has a magnetic force of about 500–700 gauss at point remote from the surface by about 2 mm.

70. A magnetic toner conveying apparatus according to claim 61, wherein said magnetic force generating member is arranged through an angle range which is measured from a gravity direction and is selected to be $\alpha<90°$, $\beta\leqq90°$ and $\alpha<\beta$, where $\alpha$ is an angle measured in a rotational direction of said convey member and $\beta$ is an angle measured in a direction opposite to said rotational direction.

71. An electrophotographic image forming apparatus for forming an image on a recording medium, comprising:

an electrophotographic photosensitive member;

latent image forming means for forming a latent image on said electrophotographic photosensitive member;

developing means for developing a latent image formed on said electrophotographic photosensitive member by said latent image forming means with magnetic toner to form a toner image;

transfer means for transferring a toner image formed on said electrophotographic photosensitive member by said developing means onto a recording medium;

cleaning means for removing magnetic toner remaining on said electrophotographic photosensitive member after a transferring operation of said transfer means from said electrophotographic photosensitive member; and magnetic toner conveying means for conveying magnetic toner removed from said electrophotographic photosensitive member by said cleaning means, said conveying means including a non-magnetic convey path member forming a convey path for conveying magnetic toner, a non-magnetic rotary convey member arranged in said convey path member and adapted to convey magnetic toner, and a magnetic force generating member provided on an outer surface of said convey path member.

72. An image forming apparatus according to claim 71, wherein said latent image forming means comprises charging means for charging said electrophotographic photosensitive member, and exposure means for exposing said electrophotographic photosensitive member charged by said charge means in response to image information.

73. An image forming apparatus according to claim 71, wherein the electrophotographic image forming apparatus is an electrophotographic copying machine.

74. An image forming apparatus according to claim 71, wherein the electrophotographic image forming apparatus is a laser beam printer.

75. An electrophotographic image forming apparatus for forming an image on a recording medium, comprising:

an electrophotographic photosensitive member;

latent image forming means for forming a latent image on said electrophotographic photosensitive member;

developing means for developing a latent image formed on said electrophotographic photosensitive member by said latent image forming means with magnetic toner to form a toner image;

transfer means for transferring a toner image formed on said electrophotographic photosensitive member by said developing means onto a recording medium;

cleaning means for removing magnetic toner remaining on said electrophotographic photosensitive member after a transferring operation of said transfer means from said electrophotographic photosensitive member;

separating means for separating foreign matter from magnetic toner removed from said electrophotographic photosensitive member by said cleaning means; and magnetic toner conveying means for conveying magnetic toner removed from said electrophotographic photosensitive member by said cleaning means, said conveying means including a non-magnetic cylindrical member forming a convey path through which magnetic toner removed from aid electrophotographic photosensitive member by said cleaning means is conveyed to said separating means, a non-magnetic screw member arranged in said cylindrical member and adapted to convey the magnetic toner, and a magnet arranged outside of said cylindrical member.

76. An image forming apparatus according to claim 75, wherein said latent image forming means comprises charging means for charging said electrophotographic photosensitive member, and exposure means for exposing said electrophotographic photosensitive member charged by said charge means in response to image information.

77. An image forming apparatus according to claim 75, wherein the electrophotographic image forming apparatus is an electrophotographic copying machine.

78. An image forming apparatus according to claim 75, wherein the electrophotographic image forming apparatus is a laser beam printer.

79. An electrophotographic image forming apparatus for forming an image on a recording medium, comprising:

an electrophotographic photosensitive member;

charging means for charging said electrophotographic photosensitive member;

exposure means for exposing said electrophotographic photosensitive member charged by said charge means in response to image information;

developing means for developing a latent image formed on said electrophotographic photosensitive member with magnetic toner to form a toner image;

transfer means for transferring a toner image formed on said electrophotographic photosensitive member by said developing means onto a recording medium;

cleaning means for removing magnetic toner remaining on said electrophotographic photosensitive member after a transferring operation of said transfer means from said electrophotographic photosensitive member;

separating means for separating foreign matter from magnetic toner removed from said electrophotographic photosensitive member by said cleaning means; and magnetic toner conveying means for conveying magnetic toner removed from said electrophotographic photosensitive member by said cleaning means, said conveying means including a non-magnetic plastic cylindrical member forming a convey path through which magnetic toner removed from said electrophotographic photosensitive member by said cleaning means is conveyed to said separating means, a non-magnetic plastic screw member arranged in said cylindrical member and adapted to convey magnetic toner, and a plastic magnet arranged outside of said cylindrical member.

80. An image forming apparatus according to claim 79, wherein the electrophotographic image forming apparatus is an electrophotographic copying machine.

81. An image forming apparatus according to claim 79, wherein the electrophotographic image forming apparatus is a laser beam printer.

* * * * *

UNITED STATES PATENT AND TRADEMARK OFFICE

CERTIFICATE OF CORRECTION

PATENT NO. : 5,659,870

DATED : Aug. 19, 1997

INVENTOR(S) : TAKAHARA ET AL.

It is certified that error appears in the above-indentified patent and that said Letters Patent is hereby corrected as shown below:

Column 1

Line 11, "game" should read --same--.

Column 2

Line 19, "Teflon." should read --Teflon®.--.

Column 3

Line 66, "permiability" should read --permeability--.

Column 4

Line 1, "permiability" should read --permeability--;
Line 30, "portion a" should read --portion, a--;
Line 63, "drum 2" should read --drum 1--; and
Line 64, "develope" should read --develop--.

Column 5

Line 23, "(In" should read --(in--.

UNITED STATES PATENT AND TRADEMARK OFFICE

CERTIFICATE OF CORRECTION

PATENT NO. : 5,659,870

DATED : Aug. 19, 1997

INVENTOR(S) : TAKAHARA ET AL.

It is certified that error appears in the above-indentified patent and that said Letters Patent is hereby corrected as shown below:

Column 9

Line 62, "of" should be deleted

Column 10

Line 27, "of" should be deleted.

Column 12

Line 17, "convey" should read --conveying--; and
Line 50, "S" should read --ß--.

Column 13

Line 19, "point" should read --a point--;
Line 23, "point" should read --a point--;
Line 27, "point" should read --a point--; and
Line 31, "point" should read --a point--.

UNITED STATES PATENT AND TRADEMARK OFFICE

CERTIFICATE OF CORRECTION

PATENT NO. : 5,659,870

DATED : Aug. 19, 1997

INVENTOR(S) : TAKAHARA ET AL.

It is certified that error appears in the above-indentified patent and that said Letters Patent is hereby corrected as shown below:

Column 14

Line 6, "charge" should read --charging--;

Line 38, "aid" should read --said--; and

Line 63, "charge" should read --charging--.

Signed and Sealed this

Twenty-eighth Day of April, 1998

Bruce Lehman

*Attest:*

BRUCE LEHMAN

*Commissioner of Patents and Trademarks*

*Attesting Officer*